US005502973A

United States Patent [19]

Lehman

[11] Patent Number: 5,502,973

[45] Date of Patent: Apr. 2, 1996

[54] RESERVOIR FOR THE STORAGE OF GAS UNDER HIGH PRESSURE AND INSTALLATION FOR THE STORAGE AND SUPPLY OF GAS UNDER HIGH PRESSURE

[75] Inventor: Jean-Yves Lehman, Maison-Alfort, France

[73] Assignee: L'Air Liquide, Societe Anonyme pour l'Etude et l'Exploitation des Procedes Georges Claude, Paris Cedex, France

[21] Appl. No.: 303,506

[22] Filed: Sep. 9, 1994

[30] Foreign Application Priority Data

Sep. 9, 1993 [FR] France ..... 93 10701

[51] Int. Cl.[6] ..... F17C 7/02

[52] U.S. Cl. ..... 62/50.1; 62/45.1

[58] Field of Search ..... 62/47.1, 50.1, 62/50.2, 51.1, 45.1

[56] References Cited

U.S. PATENT DOCUMENTS

| | | | |
|---|---|---|---|
| 2,037,673 | 4/1936 | Zenner | 62/50.2 |
| 2,042,427 | 5/1936 | Kinzel | 62/47.1 |
| 2,217,467 | 10/1940 | Bonnaud | 62/50.2 |
| 2,609,668 | 9/1952 | Dalton | 62/50.1 |
| 3,092,283 | 6/1963 | Trepp | 62/45.1 |
| 3,191,395 | 6/1965 | Maher et al. | 62/47.1 |
| 3,254,498 | 6/1966 | Becker | 62/45.1 |
| 3,650,290 | 3/1972 | Moen et al. | 137/339 |
| 3,818,715 | 6/1974 | Scurlock | 62/45.1 |
| 4,175,395 | 11/1979 | Prost et al. | 62/50.2 |
| 4,277,950 | 7/1981 | Eigenbrod et al. | 62/50.1 |
| 4,888,955 | 12/1989 | Tyree, Jr. et al. | 62/47.1 |
| 5,335,503 | 8/1994 | Lee | 62/50.1 |

FOREIGN PATENT DOCUMENTS

| | | |
|---|---|---|
| 2093708 | 1/1972 | France . |
| 1047811 | 12/1958 | Germany . |

*Primary Examiner*—Ronald C. Capossela
*Attorney, Agent, or Firm*—Young & Thompson

[57] ABSTRACT

A reservoir for the storage of gas under high pressure comprises an enclosure portion (2) which is uninsulated and an enclosure portion (2A) which is insulated. The two portions (2A, 2B) are connected by an insulated passage (18) insulated from the enclosure portions. The uninsulated portion (2B) defines a gaseous sky limiting the instantaneous pressure drops during withdrawal of liquid from the insulated portion (2A) to decrease the response time of the heating of an external circuit to maintain pressure. Used particularly in safety installations of a principal source for the production of gas under high pressure.

9 Claims, 3 Drawing Sheets

RESERVOIR FOR THE STORAGE OF GAS UNDER HIGH PRESSURE AND INSTALLATION FOR THE STORAGE AND SUPPLY OF GAS UNDER HIGH PRESSURE

The present invention relates to installations for the storage and supply of gas under high pressure and more particularly a storage reservoir of gas under high pressure for such an installation.

An installation of this type is described in French Patent Application No. 93.08394 in the name of the Applicant and uses a reservoir for the storage of gas at least partially in liquid phase and under high pressure, particularly supercritical pressure. The maintenance under such a high pressure of a gas supply permits instantly to supply to the user station gas under high pressure, particularly for the safety of the principal installation for the supply of this gas under said high pressure.

In such an installation, when liquid contained in the reservoir is withdrawn, there normally is produced in this latter a very rapid pressure drop because of the low compressibility of the liquid which is stored there and, depending on the response time of the external circuit for pressure maintenance, it is possible that the pressure of the gas supplied will be temporarily less than the desired value for the user station.

The present invention has for its subject to provide a new storage reservoir structure for the storage of gas under high pressure permitting overcoming these drawbacks.

To do this, according to one characteristic of the invention, the reservoir comprises a first portion comprising means for maintaining at a first cold temperature, particularly less than −100° C., a second portion comprising means for maintaining at a second substantially higher temperature than the first temperature, typically greater than −20° C., and at least one passage establishing free communication of fluid between the first and second reservoir portions and associated with means limiting the heat transfer between the first and second reservoir portions.

According to other characteristics of the invention:

- the first portion is thermally insulated and at least one portion of the second portion is not externally insulated;
- the passage has a reduced internal cross-section relative to the principal sections of the first and second reservoir portions.

The present invention also relates to an installation for the storage and supply of gas under high pressure at at least one user station, comprising such a reservoir whose first portion is connectible to the user station by a supply line comprising a heater.

Further characteristics and advantages of the present invention will become apparent from the following description of embodiments, given by way of illustration, but in no way limiting, with respect to the accompanying drawings, in which.

In the description which follows and in the drawings, identical or analogous elements bear the same reference numerals, sometimes primed.

Figure 1:
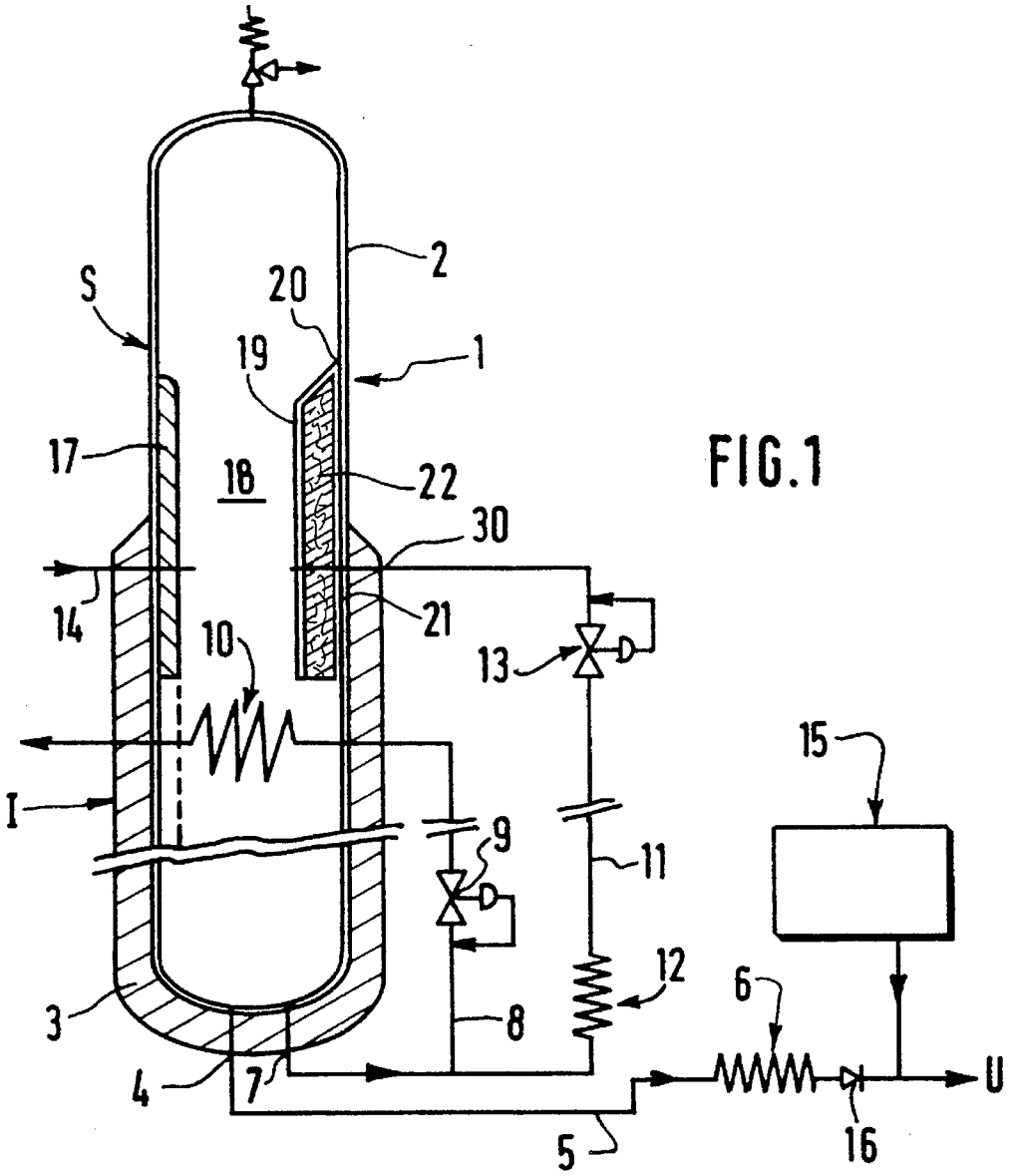
FIG. 1 is a schematic view of an installation for the storage and supply of gas under high pressure using a storage reservoir according to a first embodiment of the invention.

In the embodiment shown in FIG. 1, the reservoir 1 comprises an oblong enclosure 2, resisting pressure, defining an internal storage volume and comprising an upper portion S in which the enclosure 2 is not insulated and is therefore in heat exchange relation with the ambient atmosphere, and a lower portion I of greater capacity having a thermal insulation 3. The lower insulated portion I comprises at its base a first outlet 4 from which leaves toward at least one user station U, a supply line 5 comprising a heater or vaporizer 6, and a second outlet 7 to which is connected a first fluid circuit 8 comprising, outside the reservoir 1, a valve 9 controlled by the pressure prevailing in the reservoir and passing through a heat exchanger 10 in heat exchange relation with fluid in the lower portion I of the reservoir 1 then opening outwardly from the lower portion of the reservoir. To the second outlet 7 is also connected a second fluid circuit 11 comprising in series, outside the reservoir 1, a reheater 12, valve 13 controlled by the pressure prevailing in the reservoir 1, and opening into this latter through an inlet 30. Into the lower portion I opens a filling conduit 14 permitting filling the reservoir 1 with liquified gas under high pressure.

The invention which has been described can be used insulated to supply the user station U with small quantities of gas under high pressure but is preferably used for the safety of the principal unit 15 for the supply of high pressure gas to the user station U, in which case the supply line 5 can be provided at its downstream end with a monitoring valve 16.

In the embodiment shown in the left portion of FIG. 1, the region of the enclosure 2 bridging the junction between the two insulated and uninsulated portions land S comprises an internal insulation covering 17 defining, within the enclosure 2, at least one vertical internal passageway 18 establishing free communication between the lower portion I, enclosing gas in liquid phase, and the upper portion S which thus delimits precisely a gaseous sky within the enclosure 2. As shown in broken lines, the internal insulation 17 can be prolonged within the lower portion I of the reservoir. Preferably, as shown in the right portion of FIG. 1, passageway 18 is delimited peripherally by a metallic skirt 19 extending at a distance inwardly of the adjacent wall of the enclosure 2, but connected hermetically by its upper end at 20 to this latter, so as to provide, about the central passage 18, an annular space 21 communicating with the internal volume of the lower portion I, insulating the passage 18 from the adjacent uninsulated portion of the upper portion S of the enclosure 2 and limiting the thermal bridge to the junction between the two portions of the enclosure.

Preferably, the skirt 19 is peripherally covered with a layer 22 of insulation, typically of porous material, for example, glass fiber cloth, substantially filling the annular space 21 between the skirt 19 and the internal of the enclosure 2.

Figure 2:
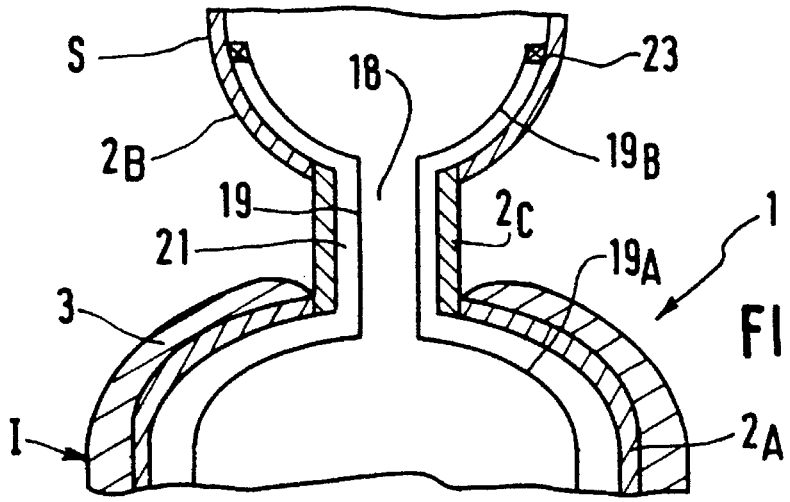
FIG. 2 is a partial schematic view, in longitudinal cross-section, of a second embodiment of a reservoir according to the invention.

The effect of restricting central passage 18 between the internal volumes of the upper and lower portions I and S can be still further increased in the embodiment shown in FIG. 2. In this embodiment, the reservoir enclosure is of three parts: a principal lower part 2A supporting an upper portion of reduced dimensions 2B, connected together by an intermediate cylindrical portion 2C of reduced diameter, only the lower portion 2A being provided with insulation 3. The passage 18 is in this case constituted by a tube 19 extending coaxially within the intermediate enclosure portion 2C, at a distance internally of this latter, and flaring toward the upper and lower portions S and 1 in end portions 19B and 19A having profiles corresponding substantially to the internal profiles of the corresponding enclosures 2B and 2A, at a distance from these latter. The upper end of the upper flared portion is 19B is fixed and sealed to the upper enclosure portion 2B by an insulating ring 23 thereby providing entirely about the internal structure 19, 19B, 19A, an insulation space communicating with the lower portion I of the reservoir but insulated from the upper portion S and preferably provided at least partially with an external insulation such as 22 as described above. In the use for the storage of liquid nitrogen under high pressure (which can be $100\times10^5$ pa), the temperature of the skin of the upper portion of enclosure 2B is the ambient temperature (20° C.) while most of the internal passage structure 18, 18B, 18A is maintained at the low temperature (−80° C.) prevailing in the lower portion I of the reservoir 1.

Figure 3:
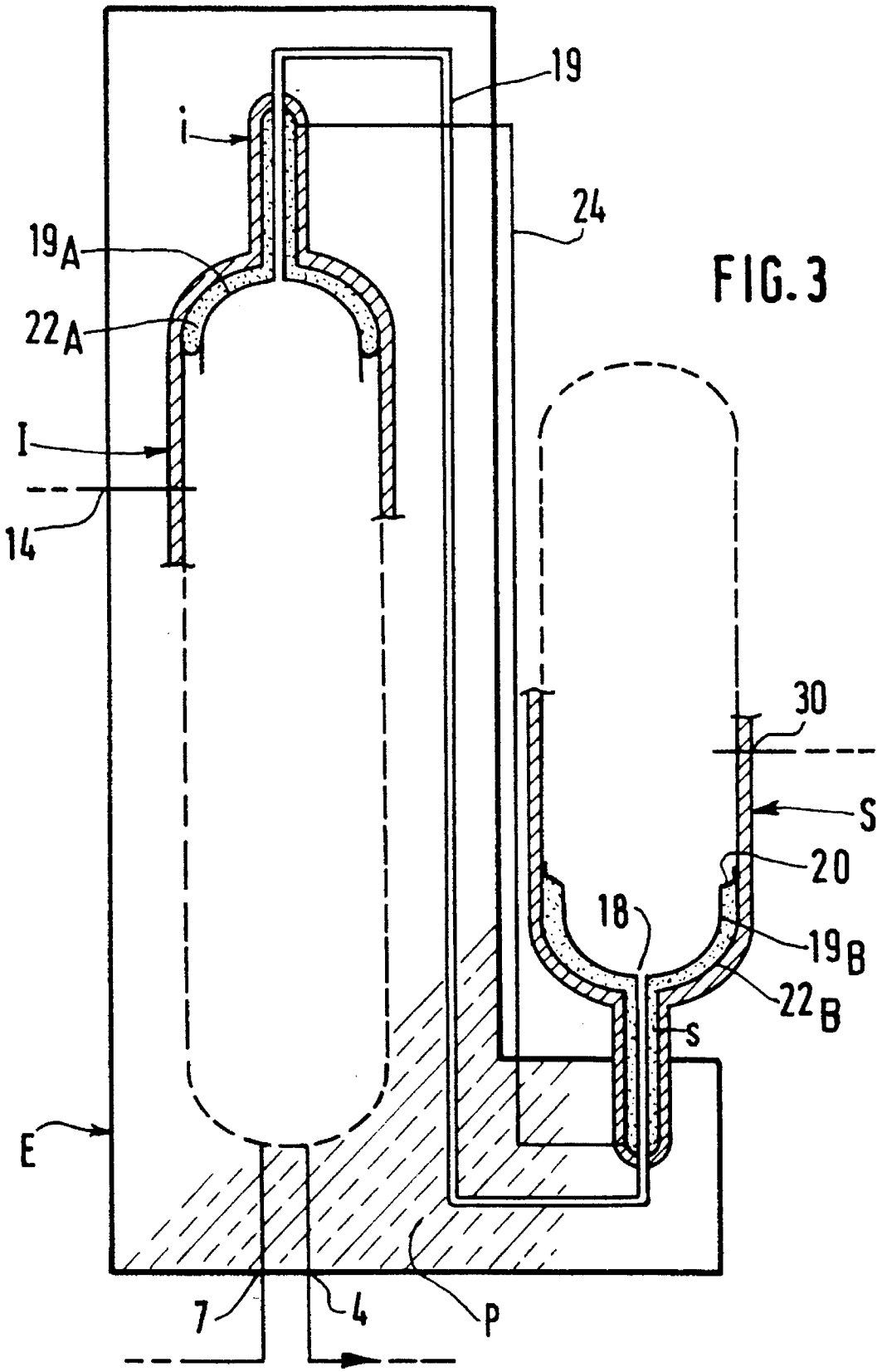
FIG. 3 is a schematic view in cross-section of a third embodiment of reservoir according to the invention.
Figure 4:
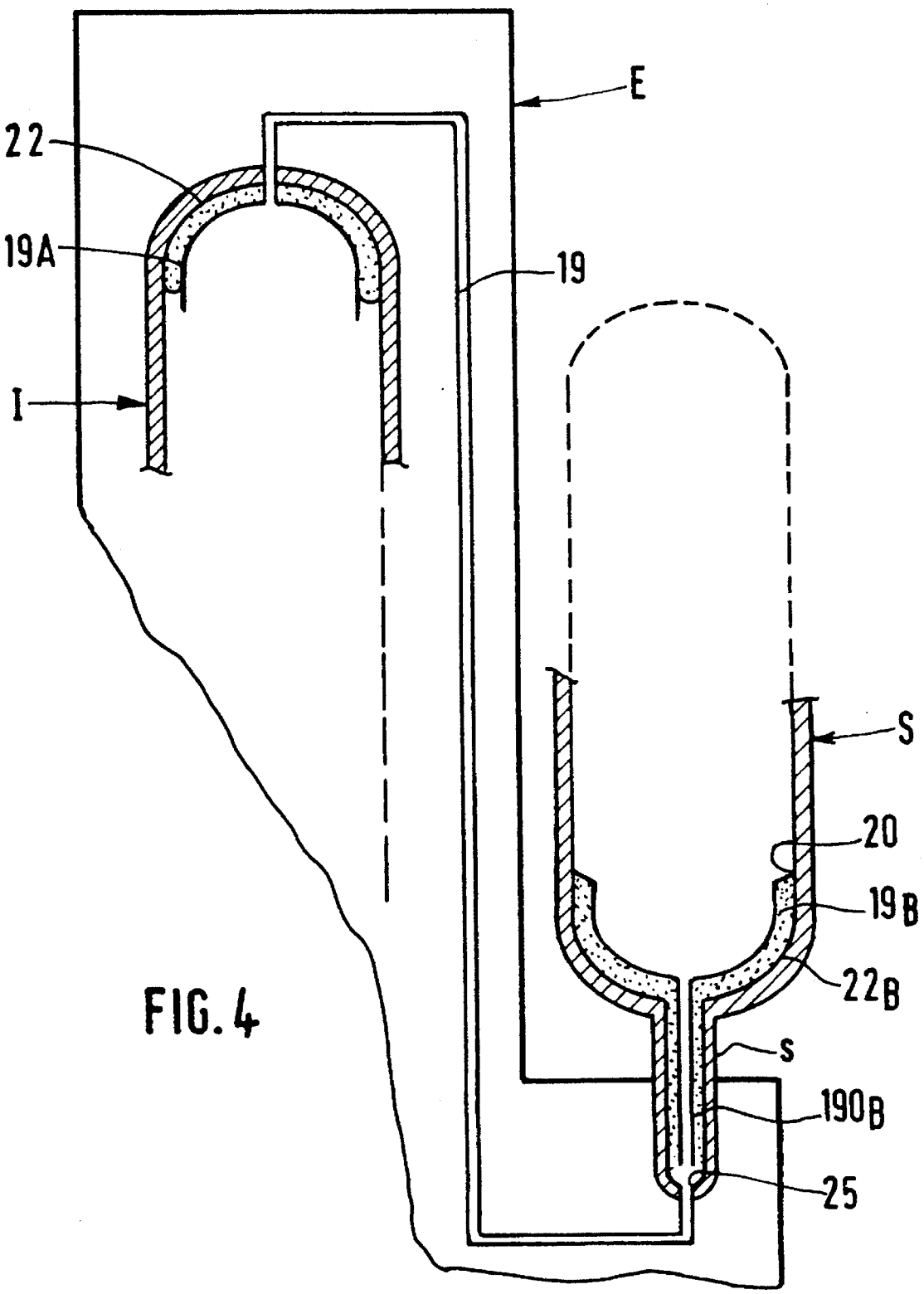
FIG. 4 is a partial schematic view of a modification of the embodiment of FIG. 3.

In the embodiment of FIG. 3, the reservoir portions S and I are separate and each is constituted by its own uninsulated reservoir enclosure, comprising preferably a narrowed end portion s and i and arranged head to tail. Although the "warm" reservoir portion S is exposed to the ambient atmosphere, the "cold" reservoir portion I, as well as preferably the end region s of the "warm" reservoir portion S, are enclosed in an enclosure E filled with thermal insulating material P, typically of perlite. There will also be seen the connecting tube 19 connecting the two reservoir portions by extending within the enclosure E, the tube 19 being prolonged, as in the embodiment of FIG. 2, into each portion of the reservoir by an end portion 19A, 19B, respectively, flaring at a distance from the interior of the adjacent wall of the reservoir portion. An insulation 22A, 22B, respectively, is preferably provided in the space between the ends of the tube 19 and the adjacent walls of the enclosure portions.

Although the invention has been described with respect to particular embodiments, it is not thereby limited but is on the contrary susceptible to modifications and variations which will be apparent to those skilled in the art. In particular, for very cold countries, the warm portion S of the reservoir can comprise heating means, using for example, hot compressed gas removed from the unit 15, and can itself be lightly insulated.

What is claimed is:

1. An apparatus for the storage and supply of a cryogenic fluid under high pressure, comprising:

a first tank portion which is thermally insulated and has an upper part, and a bottom part including an outlet for connection to a high pressure fluid delivery line;

a second tank portion which is at least partly free from thermal insulation and has a lower part; and fluid flow transfer means for establishing permanent free fluid communication between the lower part of the second tank portion and the upper part of the first tank portion, the fluid flow transfer means including means for limiting heat transfer between the first and second tank portions.

2. The apparatus of claim 1, wherein the fluid flow transfer means comprises conduit means having end portions extending into the first and second tank portions, respectively.

3. The apparatus of claim 2, further comprising inner thermal insulating means for thermally insulating the conduit means relative to the first and second tank portions.

4. The apparatus of claim 1, wherein the second tank portion is arranged above the first tank portion.

5. The apparatus of claim 4, wherein the first and second tank portions are formed in a same tank envelope.

6. The apparatus of claim 1, wherein the first and second tank portions are arranged side by side.

7. The apparatus of claim 1, further comprising a second outlet in the bottom part of the first tank portion for feeding at least an auxiliary external fluid circuit.

8. The apparatus of claim 7, further comprising a first external circuit extending outwardly from the second outlet in the bottom part of the first tank portion and having a portion including a heat exchanger extending through the first tank portion.

9. The apparatus of claim 7, comprising a second external circuit including an outer heat exchanger and extending outwardly from the second outlet and discharging into the upper part of the first tank portion.

* * * * *